United States Patent [19]

Mohler

[11] 4,191,257

[45] Mar. 4, 1980

[54] SPRINKLER-SEALING DEVICE

[76] Inventor: Johann G. Mohler, Laugneristrasse, CH-6353 Weggis, Switzerland

[21] Appl. No.: 955,825

[22] Filed: Oct. 30, 1978

[30] Foreign Application Priority Data

Dec. 23, 1977 [CH] Switzerland ..... 16013/77

[51] Int. Cl.[2] ..... A62C 37/20

[52] U.S. Cl. ..... 169/90; 251/147

[58] Field of Search ..... 169/90; 251/228, 147; 137/884

[56] References Cited

U.S. PATENT DOCUMENTS

| | | | |
|---|---|---|---|
| 1,167,860 | 1/1916 | Van Dillen et al. | 169/90 |
| 2,555,461 | 6/1951 | Auguste | 169/90 |
| 3,191,685 | 6/1965 | Warne | 169/90 |
| 3,976,141 | 8/1976 | Harrington | 169/90 |

*Primary Examiner*—Charles A. Marmor

*Attorney, Agent, or Firm*—Ladas, Parry, Von Gehr, Goldsmith & Deschamps

[57] ABSTRACT

A sprinkler-sealing device has a control member which can be coupled to a manually used operating rod system to activate a sealing element intended to seal the nozzle opening of a sprinkler against water. A housing is provided comprising recesses and guides to take up and position the control member and the sealing element. A pair of stops is located at the front side of said housing for approximative alignment of the housing with the sprinkler to be sealed. Spring-loaded gripping members are connected moveably with the housing for releasable connection of the housing to said sprinkler.

3 Claims, 2 Drawing Figures

SPRINKLER-SEALING DEVICE

Figure 1:
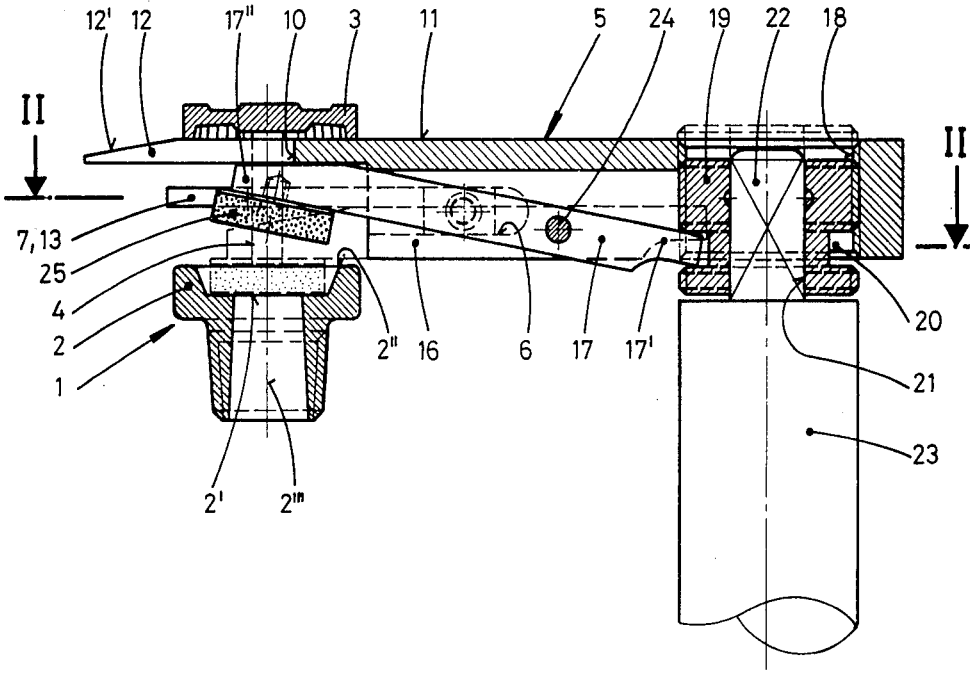

The present invention relates to a sprinkler-sealing device for sprinklers which are suspended or in a standing position, in particular to a sprinkler-sealing device with a control member which can be coupled to a manually used operating rod system to activate a sealing element intended to seal the nozzle opening of a sprinkler against water.

If one considers on the one hand that the releasing member of a sprinkler is, with most of the sprinklers used today, destroyed upon activation (bursting of the small glass bottle, melting of a fusible cutout etc) which can also occur when there is no emergency, and on the other hand that feed-pipes of a sprinkler system should, for safety reasons, be made free of water pressure for at the most short periods, then it becomes clear that if the system is activated by mistake, the trouble should be eliminated as quickly as possible and without damaging the operating conditions, if possible. Especially in systems with far-reaching branches and a large number of critical control points, even temporary reductions in pressure or interruptions of the water supply are connected with grave risks. Neutralization of the full protection condition is therefore to be limited to a minimum period of time.

It is therefore the purpose of the present invention to provide a sprinkler sealing device of the type described at the beginning, which allows the sealing of a single sprinkler which was mistakenly activated, if necessary, when the water-flow is fully released, without having to make the whole system or important parts thereof free of water-pressure.

The solution of this object according to the invention is given in the characterizing features of the Main claim.

Figure 2:
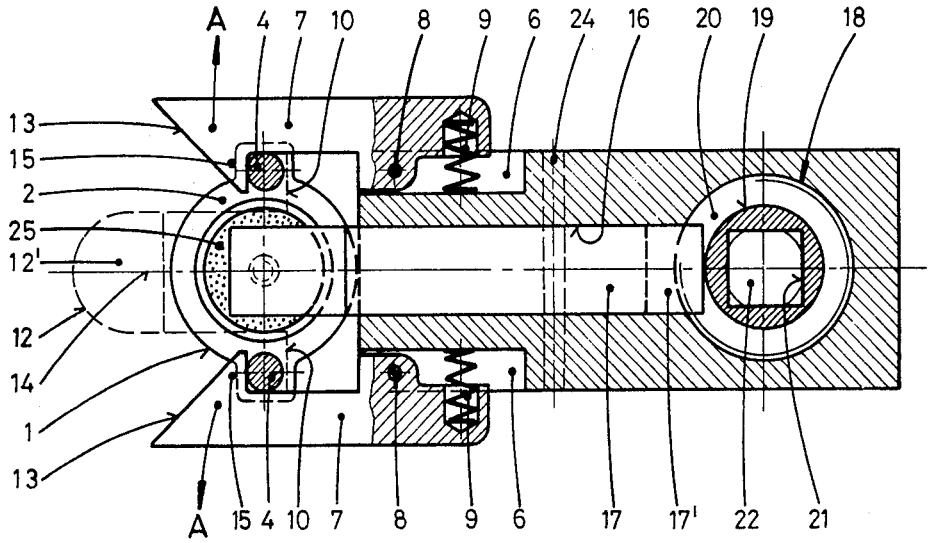

An embodying example of such a sprinkler sealing device is described in the following, on the basis of the drawing. Therein shows:

FIG. 1 a vertical cross-section of a device according to the invention, engaged with a sprinkler, the release member of which is ejected, and FIG. 2 a cut along the line II—II in FIG. 1.

In FIGS. 1 and 2, a sprinkler nozzle 1 of the normal type with a nozzle body 2, an impact plate 3 and (shown in dotted lines) carrier bolts 4 which connect the impact plate with the nozzle body 2 are shown. The base body 5 bearing the component parts of the sealing device has the shape of a housing, in which two gripping members 7 arranged as mirror images of one another in side-recesses 6 are disposed to pivot about each one joint pin 8 against a pressure spring 9 in the direction of arrow A and vertical to the plane of the nozzle axis 2'''. Protruding over the front edge of the housing which forms a stop pair 10 for the device when it is in operation, as an even extension of the housing top side 11, is a guide tongue 12, the width of which is somewhat less than the inside width between the carrier bolts 4, in regard to which the tongue centralizes the sealing device upon its insertion into the sprinkler. To facilitate the insertion of the sealing device into the sprinkler, the run-in area 12' of the guide tongue 12 is slightly sloping and rounded at the front (FIG. 2). The gripping members 7 have, disposed opposite the tongue 12, run-in surfaces 13, the converging course against the longitudinal axis 14 of the sealing device of which is so chosen that they pivot slightly outwards—against the bias force of the springs 9—when inserting the sealing device into the sprinkler 1. A hooked ledge 15 on the inner ends of the run-in surfaces 13 on each of the gripping members 7 allows the device to be fixed firmly on the carrier bolts 4 upon full insertion of the sealing device into the sprinkler.

On its underside (FIG. 1) the housing 5 comprises an axially orientated indentation 16 to take up a locking lever 17 which is pivotable in a plane contained in the longitudinal axis 2''' of the sprinkler 1. The housing 5 further comprises a threaded hole 18 on its end opposite the guide tongue 12 to take up a spindle nut 19. The spindle nut 19 contains on the one side a circular surrounding slot 20, into which the backward set end 17' of the locking lever 17 engages, and on the other side an axially central 4-sided-plug opening 21 to take up a 4-sided connection end 22 at the top end of an operating pin 23. By turning the operating pin 23, the spindle nut 19 can be screwed up- and downwards in the housing 5.

The locking lever 17 is located in the recess 16, pivotable about a joint pin 24. It carries a sealing element 25 on its front end 17'', preferably a rubber plug screwed or stuck onto the lever end 17''. The diameter of the plug is about equal to that of the sealing seat 2'.

In the stand-by position of the sprinkler-sealing device shown, the spindle nut 19 is in the position shown in solid lines in FIG. 1, i.e. screwed downwards. By the action of the tapered end 17' of the locking lever 17 in the slot 20, the front end 17'' of the locking lever bearing the rubber plug 25, is brought into its final top position, also shown in solid lines. The distance between the top edge 2'' of the nozzle body 2 and the point on the rubber plug 25 lying nearest to this edge is now so large that it is even possible in the presence of a flow of water from the nozzle opening, to enter between the carrier bolts 4 of the spinkler 1, firstly with the rounded run-in surface 12' of the guide tongue 12 and subsequently with the front end 17'' of the locking lever 17 which bears the rubber plug.

For this procedure, the sealing device has already been appropriately set onto the operating pin 23, whereby its 4-sided connection end 22 is in the central plug opening 21 of the spindle nut 19. The device can be brought in this way onto the sprinkler to be sealed like a one-headed hammer. When the stop pair 10 on the housing 5 of the sealing device shown impacts on the carrier bolts 4 of the sprinkler, the gripping members 7 which were open have closed during insertion of the guide tongue 12 between the carrier bolts 4 and their hooked ledges 15 hold the sealing device onto the sprinkler. If one now turns the operating pin 23 so that the spindle nut is pushed upwards, the locking lever 17 is pivoted anticlockwise until the rubber plug 25 comes to lie on the sealing seat 2' on the nozzle body 2 and is finally in pressure-tight contact with this seat. Replacement of the sprinkler can now be carefully prepared so that only a short interruption of the readiness of the sprinkler system results.

It is understood that the sprinkler sealing device described by way of example is useable for both standing and suspended sprinkler nozzles. With suspended arrangements based on FIG. 1, the operating pin 23 need only be inserted into the 4-sided plug opening of the spindle nut 19 from the other side so that the guide tongue 12 again comes to lie against the sealing seat 2' of the nozzle body.

I claim:

1. In a sprinkler system with a large number of sprinkler nozzles, a sprinkler-sealing device which can be coupled to a manually used operating rod system to activate a sealing element intended to individually seal a single sprinkler nozzle and interrupt the flow of water, comprising a recessed housing and guiding means to take up and position a control member and the sealing element, stop and centralizing means located on the front side of said housing for approximative alignment of the housing with the sprinkler nozzle to be sealed, spring-loaded fixing means movably connected with the housing for releasable connection of the housing to said sprinkler, a locking lever pivotably located in the housing in the plane of the sprinkler axis, one end of said locking lever carrying the sealing element intended to seal the nozzle opening of the sprinkler, and the control member comprising a spindle nut with a central take-up opening for the operating rod system located pivotably in a threaded hole of the housing and having a circular surrounding slot to operably engage the other operating end of the locking lever.

2. The device according to claim 1, wherein the fixing means comprises gripping members with clamping jaws facing each other and pivotably disposed on vertical pivots carried by said housing, these clamping jaws being, during insertion of a guide tongue between the said pivots, laterally expandable outwards against the return force of compression springs.

3. The device according to claim 2, wherein the gripping members have at their free end, run-in surfaces which converge and slope inwards in the direction of insertion of the device.

* * * * *